US006427242B1

(12) United States Patent
Bush et al.

(10) Patent No.: US 6,427,242 B1
(45) Date of Patent: Aug. 6, 2002

(54) GARMENT LINING SYSTEM CHARACTERIZED BY LOCALIZED PERFORMANCE PROPERTIES

(75) Inventors: Trent Bush; Troy Bush, both of Boulder, CO (US); Greg Dacyshyn, Waterbury, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/477,988

(22) Filed: Jan. 5, 2000

(51) Int. Cl.[7] ..... A41B 00/00; A41D 1/00

(52) U.S. Cl. ..... 2/69; 2/81; 2/93; 2/488; 2/87; 2/97; 2/272

(58) Field of Search ..... 2/69, 81, 93, 458, 2/87, 97, 272, DIG. 1, 904

(56) References Cited

U.S. PATENT DOCUMENTS

| | | | | |
|---|---|---|---|---|
| 1,015,231 | A | 1/1912 | Jacobs | |
| 1,195,738 | A | 8/1916 | Rose | |
| 1,329,025 | A | 1/1920 | Smith | |
| 1,350,169 | A | 8/1920 | Mullane | |
| 1,363,981 | A | 12/1920 | Jenkins et al. | |
| 1,647,656 | A | 11/1927 | Olsen | |
| 2,079,980 | A | 5/1937 | Anders | 2/115 |
| 2,114,514 | A | 4/1938 | York | 2/93 |
| 2,281,510 | A | 4/1942 | Neumark | 2/97 |
| 2,295,741 | A | 9/1942 | Kessler | 2/97 |
| 2,327,979 | A | 8/1943 | Bailey | 2/97 |
| 2,391,535 | A | 12/1945 | Zelano | 2/93 |
| 2,483,015 | A | 9/1949 | Levy | |
| 2,651,041 | A | 9/1953 | Sunderland et al. | 2/97 |
| 2,990,550 | A | 7/1961 | Locketz | 2/97 |
| 3,153,793 | A | 10/1964 | Lepore | 2/93 |

(List continued on next page.)

FOREIGN PATENT DOCUMENTS

| | | |
|---|---|---|
| JP | 10 212610 | 8/1998 |

OTHER PUBLICATIONS

International Search Report for International Application No. PCT/US 01/00250 dated May 18, 2001.

*Primary Examiner*—John J. Calvert
*Assistant Examiner*—Robert H. Muromoto, Jr.
(74) *Attorney, Agent, or Firm*—Wolf, Greenfield & Sacks

(57) ABSTRACT

The invention is a garment lining that provides localized climate control. A first portion of the lining covers a kidney area of the wearer, a second portion of the lining covers the wearer's back, while a third portion is positioned relative to the underarms of the wearer. One or more performance properties of the lining is varied as between at least two or all three of the first, second and third portions.

40 Claims, 4 Drawing Sheets

U.S. PATENT DOCUMENTS

| | | | | |
|---|---|---|---|---|
| 3,651,520 | A | 3/1972 | Jacob | |
| 3,691,564 | A | 9/1972 | La Marre et al. | 2/2 |
| 3,706,102 | A | 12/1972 | Grenier | 2/84 |
| 3,710,395 | A | 1/1973 | Span et al. | 2/78 |
| 3,761,962 | A | 10/1973 | Myers | 2/79 |
| 3,801,987 | A | 4/1974 | Thompson, Jr. | 2/125 |
| 3,950,789 | A | 4/1976 | Konz et al. | 2/93 |
| 4,195,362 | A | 4/1980 | Rolando | 2/2 |
| 4,338,686 | A | 7/1982 | Bell | 2/93 |
| 4,470,155 | A | 9/1984 | Maeshima | 2/108 |
| 4,513,451 | A | 4/1985 | Brown | 2/69 |
| 4,608,715 | A | 9/1986 | Miller et al. | 2/1 |
| 4,625,336 | A | 12/1986 | Derderian | 2/79 |
| 4,696,066 | A | 9/1987 | Ball et al. | 2/272 |
| 4,722,099 | A | 2/1988 | Kratz | 2/79 |
| 4,774,725 | A | 10/1988 | Page | 2/81 |
| 4,843,646 | A | 7/1989 | Grilliot et al. | 2/69 |
| 4,843,647 | A | 7/1989 | Phillips, Sr. et al. | 2/69 |
| 4,922,552 | A | 5/1990 | Grillot et al. | 2/93 |
| 4,996,723 | A | 3/1991 | Huhn et al. | 2/105 |
| 4,998,654 | A | 3/1991 | Bruzek et al. | 224/204 |
| 5,031,244 | A | 7/1991 | Inagaki | 2/102 |
| 5,105,478 | A | 4/1992 | Pyc | 2/115 |
| 5,136,723 | A | 8/1992 | Aldridge et al. | 2/81 |
| 5,201,075 | A | 4/1993 | Syetich | 2/108 |
| 5,218,720 | A | 6/1993 | Tolton | 2/97 |
| 5,408,700 | A | 4/1995 | Reuben et al. | 2/97 |
| 5,469,581 | A | 11/1995 | Uthoff | 2/69 |
| 5,507,042 | A | 4/1996 | van der Slessen | 2/69 |
| 5,542,124 | A | 8/1996 | Grilliot et al. | 2/81 |
| 5,625,899 | A | 5/1997 | Snedeker | 2/81 |
| 5,642,526 | A | 7/1997 | Thompson | 2/79 |
| 5,692,245 | A | 12/1997 | Reuben | 2/243.1 |
| 5,704,064 | A | 1/1998 | van der Sleesen | 2/69 |
| 5,718,000 | A | 2/1998 | Ost et al. | 2/69 |
| 5,720,045 | A | 2/1998 | Aldridge | 2/81 |
| 5,727,256 | A | 3/1998 | Rudman | 2/115 |
| 5,752,277 | A | 5/1998 | van der Sleesen | 2/69 |
| 5,758,363 | A | 6/1998 | Winfree | 2/122 |
| 5,819,316 | A | 10/1998 | Aldridge | 2/81 |
| 5,845,336 | A | 12/1998 | Golde | 2/93 |
| 5,983,409 | A | 11/1999 | Aldridge et al. | 2/458 |
| 5,996,122 | A | 12/1999 | Aldridge et al. | 2/81 |

GARMENT LINING SYSTEM CHARACTERIZED BY LOCALIZED PERFORMANCE PROPERTIES

FIELD OF THE INVENTION

The present invention is a garment lining system characterized by localized performance properties.

BACKGROUND OF THE INVENTION

Apparel for active outdoor sports, such as snowboarding, skiing, hiking, snowshoeing, and the like, has become very specialized, with special attention during the design phase and the construction of such garments aimed towards enhancing certain performance properties. In connection with a lining for such active wear, improvements in materials have led to greater thermal insulation properties and to lighter weight insulating fabrics. However, before the present invention, the performance properties of the lining were not specifically tuned to the anatomical regions of the body of the wearer of the lining. Consequently, the entire body portion of the lining may have included an enhanced performance property, such as thermal insulation, when the improved performance characteristic was only needed in a localized portion or portions of the lining to achieve the desired functionality and, indeed, may have adversely affected the climate control at other portions of the garment where it unnecessarily was provided.

SUMMARY OF THE INVENTION

The present invention is a garment lining system that is specifically configured to provide desired performance properties at predetermined anatomical locations rather than universally throughout the garment lining. Although the garment lining has specific application in outdoor activewear, such as in wintersports garments, it may be used in the lining of other types of apparel as well.

In one embodiment of the invention, the garment lining includes a fabric body having a neck opening, a first portion that is associated with the kidneys of a wearer, a second portion that is associated with the back of the wearer, a third portion that is associated with the underarms of the wearer, and a waist. At least one performance property of the lining, such as thermal insulation, breathability, moisture wicking, ventilation, and moisture resistance, is varied amongst at least two of the first, second and third portions, so that such at least one performance property is not uniform throughout the first, second and third portions. In another garment lining, at least two performance properties may be varied amongst at least two of the first, second and third portions, and in still another garment lining at least three performance properties may be varied amongst at least two of the first, second and third portions. Further, there may be variations in the at least one, two and three performance properties amongst each of the first, second and third portions.

In another embodiment of the invention, a garment lining is provided having a fabric body including a neck opening, a back portion, a front and side portion for covering at least the kidney areas of a wearer, a pair of underarm portions, and a waist. The front and side portion include an air impermeable and thermally insulative fabric, while the back portion includes a breathable and thermally insulative fabric. The underarm portions provide greater ventilation and moisture wicking than either the back or the front and side portions, while the back portion provides greater moisture and vapor removal than the front and side portion.

In another embodiment of the invention, a garment lining is provided having a fabric body that includes a neck opening, a back portion, a front and side portion for covering at least the kidney areas of a wearer, a pair of underarm portions, and a waist. At least one of the front and side portion and the back portion include a thermally insulative fabric, while the pair of underarm portions include a breathable and thermally insulative fabric that permits vapor and heat removal while still providing warmth at this body area.

In another embodiment of the invention, a garment lining includes a fabric body having various predetermined portions that are associated with particular anatomical regions of a wearer that are influenced by environmental conditions, such as the cold, more readily than other anatomical regions. The fabric body portions that are associated with the more readily influenced anatomical regions being characterized by at least one performance property, such as thermal insulation, that is greater as compared to the fabric body portions that are associated with the other anatomical regions that are not as readily influenced.

It therefore is an object of the invention to provide a garment lining that is specially configured to provide different performance properties at predetermined regions of the lining.

BRIEF DESCRIPTION OF THE DRAWINGS

The foregoing and other objects and advantages of the invention will become clearer with reference to the following detailed description of the preferred embodiments as illustrated by the drawings in which.

DESCRIPTION OF EMBODIMENT OF THE INVENTION

Figure 1:
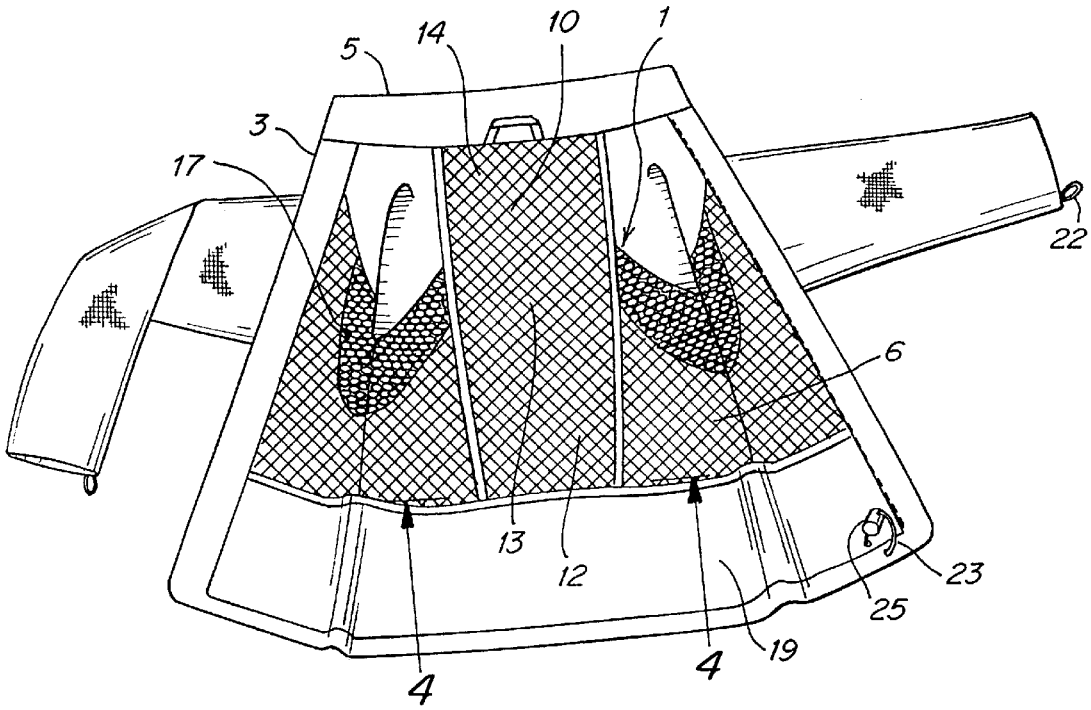
FIG. 1 is a front elevational view of one embodiment of the garment, unzipped to show interior.

The present invention is a garment lining that has been specially configured to provide localized climate control. The performance properties of the lining at selected body areas may be varied with such performance properties including, but not limited to, thermal insulation, moisture wicking, venting, breathability and moisture resistance. Because specific body areas generate different levels of heat and moisture, different portions of the garment lining may be constructed from different materials that exhibit distinct performance characteristics or such different portions of the garment lining may be constructed of the same material but with the fabric modified (e.g., variations in thickness or loft, knit/weave pattern, denier of yarns, surface treatment or coating) as between the two lining portions to vary one or more performance properties.

During intense activity, the underarm of the sports enthusiast generates a great deal of heat as well as moisture in the form of perspiration. To facilitate cooling and drying of this body area, the lining at the underarm may be completely open, that is, free of material or may include an air and moisture permeable material such as an open mesh fabric. A closed mesh fabric may instead be employed at the underarm region, particularly where thermal insulation is desired in addition to ventilation. The outer shell covering the underarm area may be provided with a vent opening that is permanently open, or selectively openable and closeable via a closure mechanism such as a zipper, allowing body heat and moisture generated at the underarms to be removed. Alternatively, the outer shell may be arranged without a vent, relying on the breathability of the outer shell for removal of the heat and vapor escaping through the underarm lining.

In certain jacket applications, it may be desirable to protect the wearer's back against the cold, and the back portion of the lining in such arrangements may include a thermal insulating fabric, such as a lightweight, mid weight or heavyweight synthetic or natural fleece, a blend of olefin and polyester fibers such as offered under the THINSULATE brand, other polyester and polyester blends, polypropylene and polypropylene blends, down and down blends, wool and wool blends, reflective metal fabrics such as aluminum, and other natural and synthetic insulating fabrics for cold weather applications. The back portion of the lining, alternatively, may be designed to remove heat and sweat that may be generated along the back of the sports enthusiast, keeping the wearer dry and warm. To maintain a desired comfort level during and after intense physical activity, the back region of the garment lining may be provided with a breathable and moisture wicking fabric, such as one formed from polypropylene, polypropylene and wool blend, and other polypropylene blends, polyester fibers, and polyester blends. Performance of the lining at the back region may be enhanced by providing a material that combines both moisture transport and insulation properties, such as is enabled by a closed mesh polyester fabric. The back portion may include a portion of the lower back, the mid-back or the upper back, and also may include combinations of these back zones, such as from the lower back to the mid back, from the upper back to the mid back, and from the lower back, across the mid back and to the upper back.

The kidney regions, and the front torso, generate a lesser amount of body heat during physical exertion then do the underarms and the back of a wearer and, consequently, it may be desirable to protect this region with material having good thermal insulation properties, such as lightweight, mid weight or heavyweight synthetic or natural fleece, a blend of olefin and polyester fibers such as offered under the THINSULATE brand, other polyester and polyester blends, polypropylene and polypropylene blends, down and down blends, wool and wool blends, and reflective metal fabrics such as aluminum. Other natural and synthetic thermal insulating materials also may be employed as would be apparent to one of skill in the art. Because there is less of a concern regarding moisture formation here, the kidney region of the lining and the front torso portion of the lining do not have to be arranged for the removal of water vapor.

The waist portion of the lining may be provided with a water resistant material, such as a nylon fabric that may further include a polyurethane or other moisture proof coating. The lining at this area is directed at preventing snow and water that may enter through the bottom of the garment from wetting the performance based lining materials and any underlying apparel. A waist gaiter may be provided here as well to enhance protection of the lining from the elements. Alternatively, or in addition to the waist gaiter, a cinching arrangement may be provided to tighten the waist of the lining about the wearer to help prevent snow and water from seeping into the garment or into the layers of apparel worn under the garment. The sleeves of the garment lining may include a nylon or other water resistant fabric, as may be an area of the garment lining adjacent the zipper or other principal closure mechanism of the garment; here again to prevent wetting of the lining and any underlying apparel.

A garment lining 1 according to the present invention includes a body portion 3 having a neck opening 5, a first portion 6 intended to overlie a kidney region of the wearer that may further extend around to the front of the wearer's body to include the chest and stomach region as well, a second portion 10 associated with the back of the wearer and including at least one of a lower back zone 12, a mid-back zone 13 and an upper back zone 14 and, preferably covering at least a portion of the lower back zone 12 and a portion of the upper back zone 14 and extending completely across the mid-back zone 13, and a third portion 17 intended to underlie or be positioned relative to the underarms of a wearer, and a waist portion 19. The performance properties of the different portions of the lining may be varied, depending upon the intended environment and application of use of the garment incorporating the lining, to provide a desired localized climate affect.

A lining 1 intended for use in a lightweight jacket especially configured for snowsports activities, such as snowboarding, is illustrated in FIG. 1. The lining includes a body portion 3, that in certain embodiments may be formed of one or more water resistant materials or may have been treated to become water resistant, and that is constructed and arranged for freedom of movement of a wearer, allowing twisting, turning, and bending by the wearer, as well as stooping, sitting and kneeling, without damage to the lining material. A first portion 6, running along the front and the sides to an extent sufficient to cover a kidney region corresponding to the kidneys of a wearer, is formed of a closed mesh polyester fabric, while the second portion 10 that is carried along the back of the lining also is formed of a closed mesh polyester fabric. The loft or weight of the closed mesh sheet may be greater in the kidney covering portion 6 than in the back portion 10 to ensure desired warmth. A third portion 17 extending below the armpits is constructed from a stretchable open mesh sheet. A waist 19 segment is formed from a waterproof nylon sheet.

Figure 2:
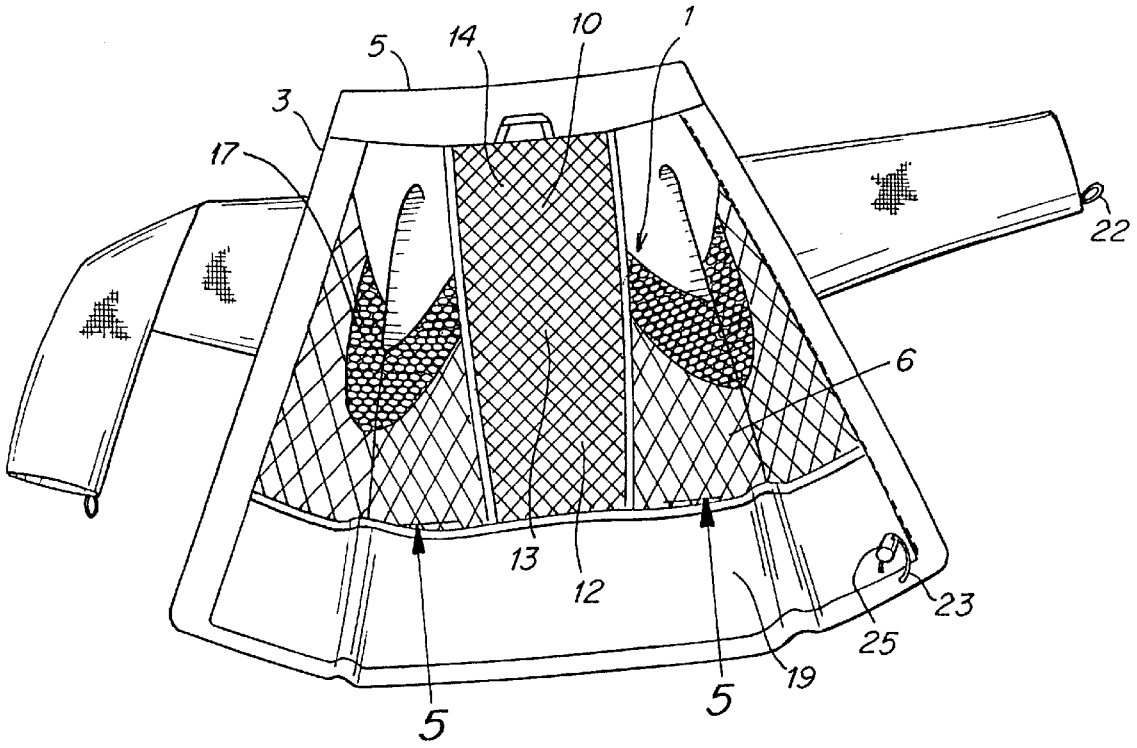
FIG. 2 is a front elevational view of another embodiment of the garment.

In a mid weight jacket illustrated in FIG. 2, also constructed for snowboarding, the first portion 6 includes a nylon or polyester tricot fabric that insulates the kidneys and the front of the wearer, while the second portion 10 includes a closed mesh polyester fabric that provides thermal insulation, although to a lesser extent than the kidney covering tricot fabric, as well as breathability for removal of body generated heat and moisture. The third portion 17 is formed of an air permeable open mesh sheet to allow enhanced cooling of the underarms, while the waist section 19 includes a water resistant nylon barrier to again prevent undue wetting of the lining components and underlying clothing. The complete lining is constructed to provide the mobility necessary for snowboarding.

Figure 3:
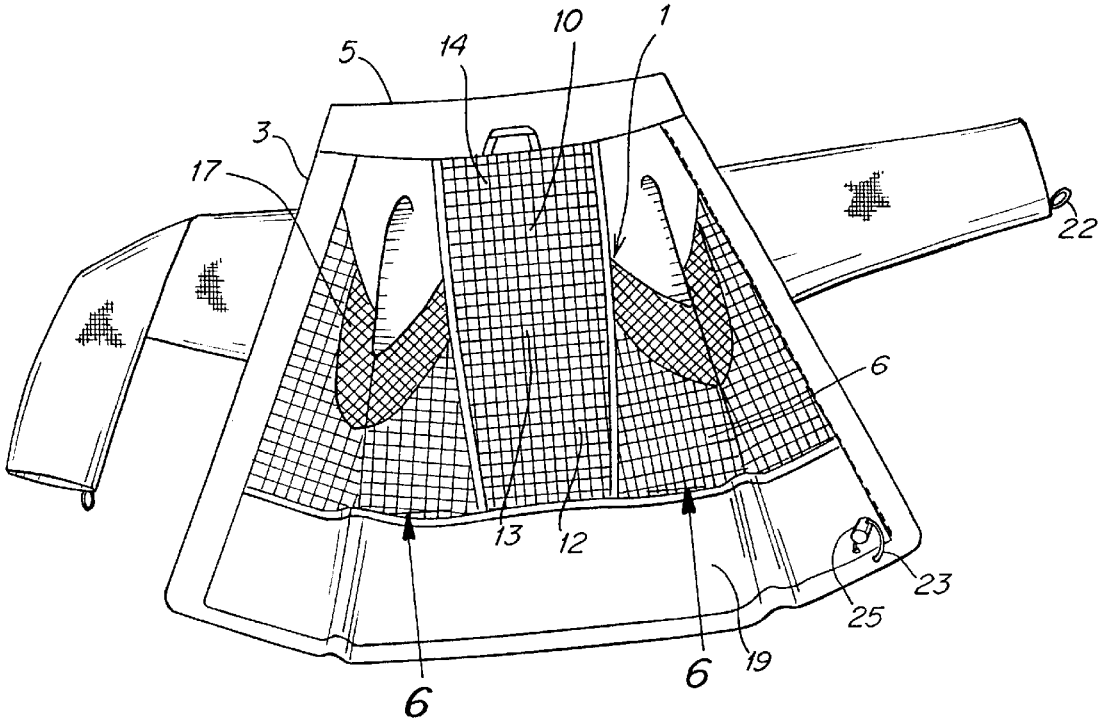
FIG. 3 is a front elevational view of another embodiment of the garment.
Figure 4:
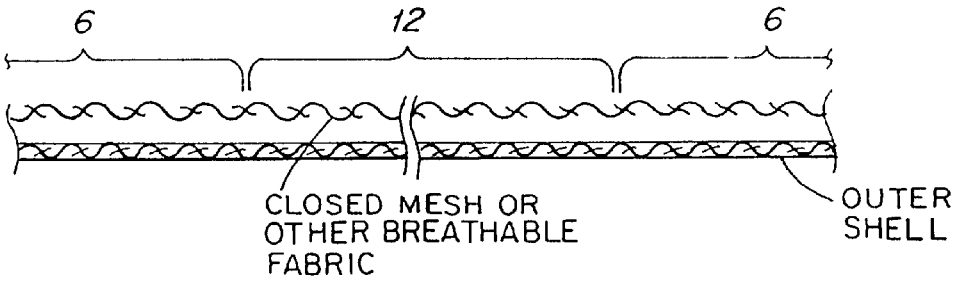
FIG. 4 is a cross sectional view of lightweight embodiment lower back and sides.
Figure 5:
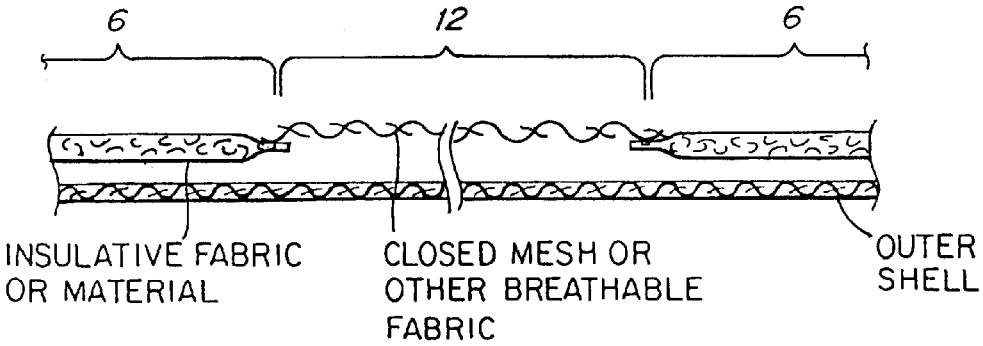
FIG. 5 is a cross sectional view of mid-weight embodiment lower back and sides.
Figure 6:
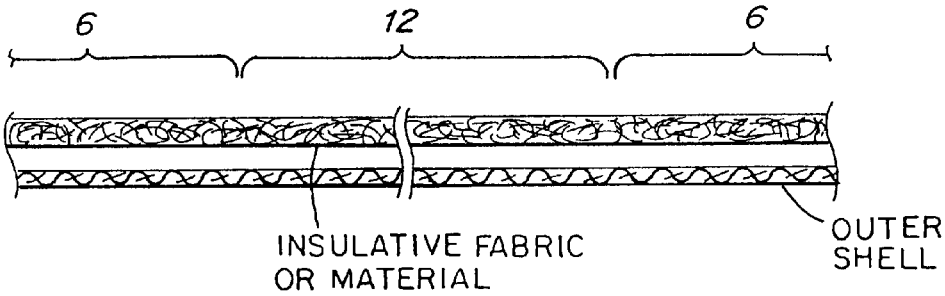
FIG. 6 is a cross sectional view of heavyweight embodiment lower back and sides.

For the heavy weight snowboarding jacket illustrated in FIG. 3, both the first portion 6 extending about the kidneys and the sides of the lining, and the second portion 10 provided along the back of the wearer, include a fleece layer for warmth, preferably formed of a heavyweight fleece fabric but which also may be formed of a lightweight or a mid-weight fleece. The same loft or weight fleece may be used in both portions or a thicker or heavier fleece may be arranged about the kidney covering sections and, if desired, elsewhere about the first portion 6. The third portion 17 is formed of closed mesh polyester sheet to permit heat and vapor transport from the underarms while still providing insulation against the cold. A waterproof nylon band runs across the waist portion 19 of the lining. Here, again, even with the heavier insulation material, the garment lining is arranged to permit the wearer to bend, twist, jump, roll and otherwise move and flex as required during a run down the slopes.

The individual sections of the garment lining may be joined together by stitching, bonding, welding and other attachment arrangements as would be apparent to one of skill in the art. Two or more adjacent portions of the lining may be formed of the same material, and may be constituted by an integral fabric sheet or two or more smaller fabric segments that are joined together. Where adjacent portions of the lining include the same material but exhibit different performance properties, an integral sheet including the adjacent portions may be employed where the performance property has been appropriately varied during construction of the fabric sheet or in subsequent processing. Alternatively, two separate sheets formed of the same material but characterized by different performance properties may be united together. The shape and dimensions of the different lining portions may be varied from the elements illustrated in the drawings, so long as the lining portions provide appropriate coverage of the anatomical areas of interest. For example, while the open and closed mesh sections employed in the third portion of the lining is shown as extending downwardly from approximately the mid-line of the armpits, the breathable or air permeable fabric could surround the complete periphery of the armpit area, or any portion of the border thereabout. Similarly, the outwardly extent of the open or closed mesh fabric may vary depending upon the application, aesthetics or other constructional considerations.

The garment lining may be stitched, welded, or bonded to the outer shell, or to an intermediate layer between the outer shell and the lining. Other attachment arrangements may also be suitable as would be apparent to one of skill in the art. Where the lining and the intermediate layer, or the lining and the outer shell, are stitched together, the stitched seam also may be taped or glued to further seal out the wind, moisture and cold. Although a permanent attachment of the lining and outer shell, whether directly or through an intermediate layer, is contemplated, it also is that releasable closure mechanisms may be employed including zipper type fasteners, buttons, snaps, hook and loop type fasteners, and tie downs, to name but a few, and these closure elements may be provided on the margin or other areas of the lining and with complementary attachment elements at a compatible location on the intermediate layer or the outer shell.

The garment lining may be configured specifically for cold weather activities and may include one or more of the following features: a waist gaiter, a neck gaiter, a sleeve gaiter, a loop 22 in a cuff or sleeve of the lining for engaging with an anchor, such as a cord lock, extending from a glove, mitten or other handwarmer, to secure the handwarmer to the lining when the wearer has removed her hand, and a pocket for storing a lift pass or other information bearing card that is hidden from view but may be revealed by lifting up the bottom of the lining. The lining also may be provided with a cinching arrangement, such as an elastic drawstring 23 and cord lock 25, or engageable straps, for drawing one or more of a hand opening, a neck opening or a waist, about the wearer to seal out wind, cold and moisture.

The foregoing has been a detailed description of one or more embodiments of the invention. Various modifications and equivalents can be made without departing from the spirit and scope of this invention. For example, the various lining materials mentioned above can be provided in a variety of knit or weave patterns, may include additional layers or coatings, may be located in a variety of areas about the lining in addition to, or instead of, the locations illustrated and described, and may be constructed in a variety of shapes and sizes. Further, while the garment lining has been described in connection with apparel for use in winter type sports, its application is not so limited and the inventive lining with varying performance properties for specific anatomical areas may be provided on other types of apparel including, but not limited to, pants, shorts, underwear, shirts, gloves, mittens and other handwarmers, hats, caps and other headwarmers, facewarmers, socks and footwear. This description is, therefore, meant to be taken only by way of example and not to otherwise limit the scope of the invention.

What is claimed is:

1. A garment, comprising:

a shell; and a lining attached to said shell, said lining having a surface that is the innermost surface of said garment, said lining including a first kidney portion for overlying a kidney region of the wearer, and a second back portion for overlying a back of the wearer, wherein said lining is constructed and arranged to provide different levels of at least one performance property along each of said first and second portions of said lining.

2. The garment of claim 1, further comprising a third underarm portion for overlying an underarm area of the wearer, wherein said lining is constructed and arranged to provide different levels of at least two performance properties along at least two of said first, second and third portions of said lining.

3. The garment recited in claim 1, wherein said first portion of said lining is more thermally insulative than said second portion of said lining.

4. The garment recited in claim 1, wherein said second portion of said lining is more breathable than said first portion of said lining.

5. The garment recited in claim 1, wherein said garment is a jacket.

6. The garment recited in claim 2, wherein said portions are constructed and arranged to provide different levels of said at least two performance properties along each of said first, second and third portions of said lining.

7. The garment recited in claim 2, wherein at least one of said at least two performance properties is selected from the group consisting of thermal insulation, breathability, moisture wicking, venting, and moisture resistance.

8. The garment recited in claim 2, wherein said at least two performance properties are selected from the group consisting of thermal insulation, breathability, moisture wicking, venting, and moisture resistance.

9. The garment recited in claim 2, wherein said lining is constructed and arranged to provide different levels of at least three performance properties along at least two of said first, second and third portions of said lining.

10. The garment recited in claim 9, wherein said at least three performance properties are selected from the group consisting of thermal insulation, breathability, moisture wicking, venting, and moisture resistance.

11. The garment recited in claim 2, wherein said lining is constructed and arranged to provide different levels of at least three performance properties along each of said first, second and third portions of said lining.

12. The garment recited in claim 2, wherein said first portion of said lining is more thermally insulative than said third portion of said lining.

13. The garment recited in claim 2, wherein said third portion of said lining provides more ventilation than said first portion of said lining.

14. The garment recited in claim 2, wherein said third portion of said lining provides more ventilation than said portion of said lining.

15. The garment recited in claim 2, wherein said first portion of said lining is formed from a thermally insulative fabric, said second portion of said lining is formed from a thermally insulative fabric, and said third portion is formed from a fabric configured for ventilation that is less thermally insulative than either of said first portion thermally insulative fabric and said second portion thermally insulative fabric.

16. A lining for a garment, comprising:

a body including a first kidney portion for overlying a kidney region of a wearer, a second back portion for overlying a back of a wearer, a third underarm portion for underlying an underarm area of the wearer, and a waist;

wherein said body provides different levels of at least one performance property along at least two of said first, second and third portions of said lining; and wherein said first portion and said second portion are formed from a fabric selected from the group consisting of fleece, closed mesh, a blend of olefin and polyester fibers, polyester, polyester blends other than polyolefin, polypropylene, polypropylene blends, wool, wool blends, down and down blends, wherein said first portion fabric is different than said second portion fabric.

17. A garment, comprising:

a lining including a back portion, a front and side portion for covering at least the kidney areas of a wearer, and a pair of underarm portions;

wherein said front and side portions of the lining include an air impermeable thermally insulative fabric, and said back portion of the lining includes an air permeable and thermally insulative fabric, and wherein said underarm portions of the lining include an air permeable fabric for ventilation of body generated heat and moisture.

18. The garment lining recited in claim 17, wherein said front and side portions provide greater thermal insulation than said back portion.

19. A garment lining, comprising:

a body portion including a neck opening, a back portion, a front and side portion for covering at least the kidney areas of a wearer, a pair of underarm portions, and a waist, wherein said front and side portion includes an air impermeable thermally insulative fabric; and wherein said pair of underarm portions provide for greater air permeability than said back portion.

20. A garment, comprising:

a shell;

a lining attached to said shell and having a surface that is the innermost surface of said garment, said lining including a fabric body having various predetermined anatomical portions that cover particular anatomical regions of a wearer, wherein at least one anatomical region is influenced by an environmental condition more readily than at least one other anatomical region;

wherein said anatomical portion that covers said at least one more readily influenced anatomical region has levels of at least two performance properties that are different than levels of said at least two performance properties for another anatomical portion that covers at least one of said other anatomical regions.

21. The garment lining recited in claim 20 wherein the environmental condition is the cold, and one of said at least two performance properties is thermal insulation.

22. The garment lining recited in claim 20 wherein the environmental condition is heat and one of said at least two performance properties is ventilation.

23. The garment lining recited in claim 20 wherein the environmental condition is body generated fluids and one of said at least two performance properties is breathability.

24. The garment lining recited in claim 20 wherein the environmental condition is body generated fluids and one of said at least two performance properties is moisture wickability.

25. The garment lining recited in claim 20 wherein the environmental condition is water and one of said at least two performance properties is moisture resistance.

26. The garment lining recited in claim 20 wherein said predetermined portions include at least one portion for covering at least one of a kidney area of a wearer, a back area of the wearer, and an underarm area of a wearer.

27. The garment lining recited in claim 20 wherein said predetermined portions include at least two portions for covering at least two of a kidney area of the wearer, a back area of the wearer, and an underarm area of a wearer.

28. The garment lining recited in claim 20 wherein said predetermined portions include at least three portions for covering each of a kidney area of the wearer, a back area of the wearer, and an underarm area of a wearer.

29. The garment of claim 1, wherein said at least one performance property is selected from the group consisting of thermal insulation, moisture wicking, moisture resistance, and breathability.

30. The garment of claim 29, further comprising a third underarm portion for overlying an underarm area of the wearer, wherein said lining is constructed and arranged to provide different levels of at least one performance property along at least two of said first and second and third portions, and wherein said at least one performance property is selected from the group consisting of moisture wicking, moisture resistance, and breathability.

31. A garment, comprising:

a shell;

a lining attached to said shell, said lining having a surface that is the innermost surface of said garment, said lining including a first portion for overlying a kidney region of a wearer, a second portion for overlying a back of the wearer, and a third portion for overlying an underarm area of the wearer;

means for providing first levels of at least two performance properties along at least one of said first, second and third portions; and means for providing second levels for said at least two performance properties along at least one of the other of said first, second and third portions that are different than said first levels.

32. The garment recited in claim 31, further comprising means for providing different levels for at least two of said at least two performance properties along both of the other of said first, second and third portions.

33. The garment recited in claim 32, wherein said garment is a jacket.

34. The lining recited in claim 16, wherein said body provides different levels of at least two performance properties along at least two of said first, second and third portions of said lining.

35. The lining recited in claim 16, wherein said body provides different levels of at least two performance properties along each of said first, second and third portions of said lining.

36. The lining recited in claim 16, wherein said body provides different levels of at least one performance property along each of said first, second and third portions of said lining.

37. The garment lining recited in claim 19, wherein said back portion includes an air impermeable fabric.

38. The garment lining recited in claim 19, wherein said kidney portion is more thermally insulative than said back portion.

39. The garment lining recited in claim 38, wherein said back portion is more thermally insulative than said underarm portion.

40. The garment recited in claim 18, wherein said pair of underarm portions provide for greater air permeability than said back portion.

* * * * *